US005445207A

United States Patent [19]

Romanelli et al.

[11] Patent Number: 5,445,207

[45] Date of Patent: Aug. 29, 1995

[54] REINFORCED COLLAPSIBLE GARAGE DOOR ASSEMBLY

[75] Inventors: Aldo Romanelli, Pompano Beach, Fla.; David K. Wegner, Milford, Mich.; George A. Sivore, Jr., Delray Beach; Dennis M. Romanelli, Lighthouse Point, both of Fla.

[73] Assignee: The Stanley Works, New Britain, Conn.

[21] Appl. No.: 150,406

[22] Filed: Nov. 10, 1993

[51] Int. Cl.[6] ..... E05D 15/26

[52] U.S. Cl. ..... 160/209

[58] Field of Search ..... 160/209, 201, 181, 233, 160/234

[56] References Cited

U.S. PATENT DOCUMENTS

| | | | |
|---|---|---|---|
| 2,526,603 | 10/1950 | Damroth . | |
| 3,176,757 | 4/1965 | Lomaz | 160/201 X |
| 3,424,223 | 1/1969 | Rosenblatt . | |
| 3,443,625 | 5/1969 | Moser et al. . | |
| 3,516,474 | 6/1970 | Pemberton et al. | 160/209 |
| 3,608,613 | 9/1971 | Halliwell | 160/201 X |
| 3,740,916 | 6/1973 | Kenaga | 160/201 X |
| 3,891,021 | 6/1975 | Geoffrey | 160/201 X |
| 4,324,189 | 4/1982 | Roldness . | |
| 4,972,924 | 11/1990 | Nielsen . | |

*Primary Examiner*—David M. Purol

[57] ABSTRACT

An overhead door reinforcement assembly has a plurality of elongated reinforcing members operatively mounted vertically on the inner surface of the door between the top edge and the bottom edge of each of the several door panels, and a plurality of cap members overlying the adjacent ends of the reinforcing members. Pivot members pivotally connect the cap members to the adjacent ends of the reinforcing members, and this permits pivoting of the panels as the door is moved between open and closed positions, but prevents pivoting of the ends of the reinforcing members in the direction of the cap members to prevent buckling of the associated door in the closed position under externally applied pressure. A disengageable lock member is engaged with the cap members and the ends of the reinforcing members to prevent pivoting of the ends of the reinforcing members away from the cap members to prevent buckling of the door panels.

27 Claims, 10 Drawing Sheets

12
38
50
58
10
24
62
96
60
14
26
148
98
64
149
86
150
71
88
40
56
18
84
78
52
144
165
82
146
71
66
68
92
90

REINFORCED COLLAPSIBLE GARAGE DOOR ASSEMBLY

BACKGROUND OF THE INVENTION

The present invention relates to a reinforcement assembly, and more particularly, to a reinforcement assembly for an overhead garage door with panels.

Overhead doors are widely employed as a means for minimizing the loss of available floor space in various structures and for facilitating movement of relatively heavy wooden doors through the use of springs and counterbalances. Such overhead doors have gained widespread acceptance in garage construction.

With the prevalent use of electrical door-opening devices, it is desired to employ relatively lightweight materials such as fiberglass and sheet metal panels to minimize the weight of the door in order to reduce the load being handled by the door-opening device. Thus, lighter weight door panels which are suitably reinforced are finding widespread use.

A particular problem with these lighter weight materials arises in geographic areas such as the so-called "hurricane belt" which are subjected to high wind velocities. Very heavy winds acting upon the exterior surface of the door tend to cause the door to buckle inwardly since the span of the door is effectively being held only by the rollers which ride in the vertical rails at the sides of the door opening.

Prior art reinforcement devices, such as that disclosed in U.S. Pat. No. 3,443,625, granted May 13, 1969, provide effective reinforcement for a garage door to prevent the inward buckling due to positive forces exerted upon the exterior of the door.

However, hurricanes and tornados generate very low pressure conditions and this can result in a substantially lower pressure exterior to an overhead door than that which exists on the interior. This can lead to substantial outward buckling and potential damage to the door structure.

Some building codes, especially those in the "hurricane belt" areas, now require the door to resist buckling in the event of both positive and negative pressures. In addition, some codes now require resistance to greater forces than those which had been previously specified.

It is an object of the present invention to provide a novel reinforcement assembly for a multipaneled door of the overhead type to reinforce the door intermediate its width, and to allow it to resist both positive and negative pressures acting upon its exterior.

It is also an object to provide such a reinforcement assembly with locking means which may be readily engaged and disengaged to avoid interference with the opening and closing movement of the door during normal use.

Another object is to provide such a reinforcement assembly which may be easily installed after fabrication and installation of the door.

A further object is to provide such a reinforcement assembly which may be fabricated readily and relatively economically.

SUMMARY OF THE INVENTION

It has now been found that the foregoing and related objects can be readily attained in a reinforcement assembly for reinforcing a door of the overhead type having a plurality of horizontally extending panels pivotably connected along their top and bottom edges. The reinforcement assembly has a plurality of elongated reinforcing members dimensioned and configured to be operatively mounted vertically on the inner surface of an associated door between the top edge and the bottom edge of each of the several door panels, and a plurality of cap members overlying the adjacent ends of the reinforcing members.

Pivot means pivotally connects the cap members to the adjacent ends of the reinforcing members and permits their relative pivotal movement in the direction away from the cap members for pivoting of the panels of the associated door as the door is moved between open and closed positions. The configuration of the cap members and pivot means prevents pivoting of the ends of the reinforcing members in the direction of the cap members to prevent buckling of the associated door in its closed position under positive pressures applied externally thereto.

Disengageable lock means is engageable with the cap members and the ends of the reinforcing members at a point spaced from the pivot means to prevent pivoting of the ends of the reinforcing members away from the cap members to prevent buckling of the panels of the associated door in its closed position of under both positive and negative pressures applied thereto.

Preferably, the reinforcement assembly also includes top locking means having a header member attachable to the header of the door frame and a catch member on the upper end of the uppermost reinforcing member. The catch member is engageable with the header member in the closed position of the door to prevent movement of the upper end of the reinforcement assembly, and is disengageable from the header member upon opening movement. In one embodiment, the header member has a hook projection, and the catch member has a projecting portion in which the hook is engageable in the closed position of the door.

The reinforcement assembly desirably incorporates bottom locking means including a latch member on the lower end of the lowermost reinforcing member for engagement with the floor of the structure about the door opening when the door is in its closed position to prevent movement of the lower end of the reinforcement assembly. The latch member is readily disengageable upon opening movement of the associated door. In one embodiment, the latch member extends beyond the lower end of the lowermost reinforcing member and a plate having an aperture therein is adapted to be secured to the floor inwardly of the door to provide a catch aperture for the latch member when the door is closed.

Desirably, the reinforcing members are of generally channel-shaped configuration with the web adapted to be disposed adjacent the panels of the door and the side walls being provided with apertures to seat the pivot means. The cap members are also of generally channel-shaped configuration and the end portions of the reinforcing members are received between their side walls and abut against their web so as to be limited in movement in the direction of the cap members. The side walls of the cap members are provided with apertures to seat the pivot means, and the web of the cap members has cutouts adjacent its ends to permit limited pivotal movement of the reinforcing members during opening and closing movement of the door.

In one embodiment, one of the reinforcing and cap members has elongated slots therein and the other of the members has apertures therein, and the pivot means comprises pivot members extending through these slots and apertures.

In a common embodiment, the reinforcement assembly includes a plurality of stiles dimensioned and configured to be mounted vertically on the several door panels of the door, with the reinforcing members being mounted on the stiles. Horizontal support members may be mounted on the reinforcing members and extend horizontally between spaced reinforcing members for larger doors that may require them to increase rigidity and strength.

For convenience of storage, the side walls of the reinforcing members are provided with apertures spaced inwardly from the ends of the cap members to receive the disengageable lock members for storage when the lock members are not in a locking position. The reinforcement assembly may also include hinge members mounted on the adjacent ends of the reinforcing members to provide a pivotal connection therebetween.

In an embodiment providing additional resistance to buckling in either direction, the reinforcement assembly includes a pair of brackets secured to the adjacent ends of the reinforcing members and which have outwardly extending portions which are configured to pivot relative to each other and to interfit in the vertical position of the assembly. In this position, a disengageable locking member engages the interfitting portions to lock them against relative pivotal movement. Desirably, the outwardly extending portions protrude through an aperture intermediate the length of the cap member in the vertical position and the locking member comprises an elongated member passing through the aligned apertures in the protruding portions which bears upon the cap member to prevent pivoting of the ends of the reinforcing members away from the cap member.

As will be appreciated, the reinforcement assembly is utilized in a building structure having a door opening with a frame providing a header thereabove and a floor therebelow, and a door of the overhead type having a plurality of horizontally extending panels pivotably connected along their top and bottom edges.

DETAILED DESCRIPTION OF THE PREFERRED EMBODIMENT

Figure 1:
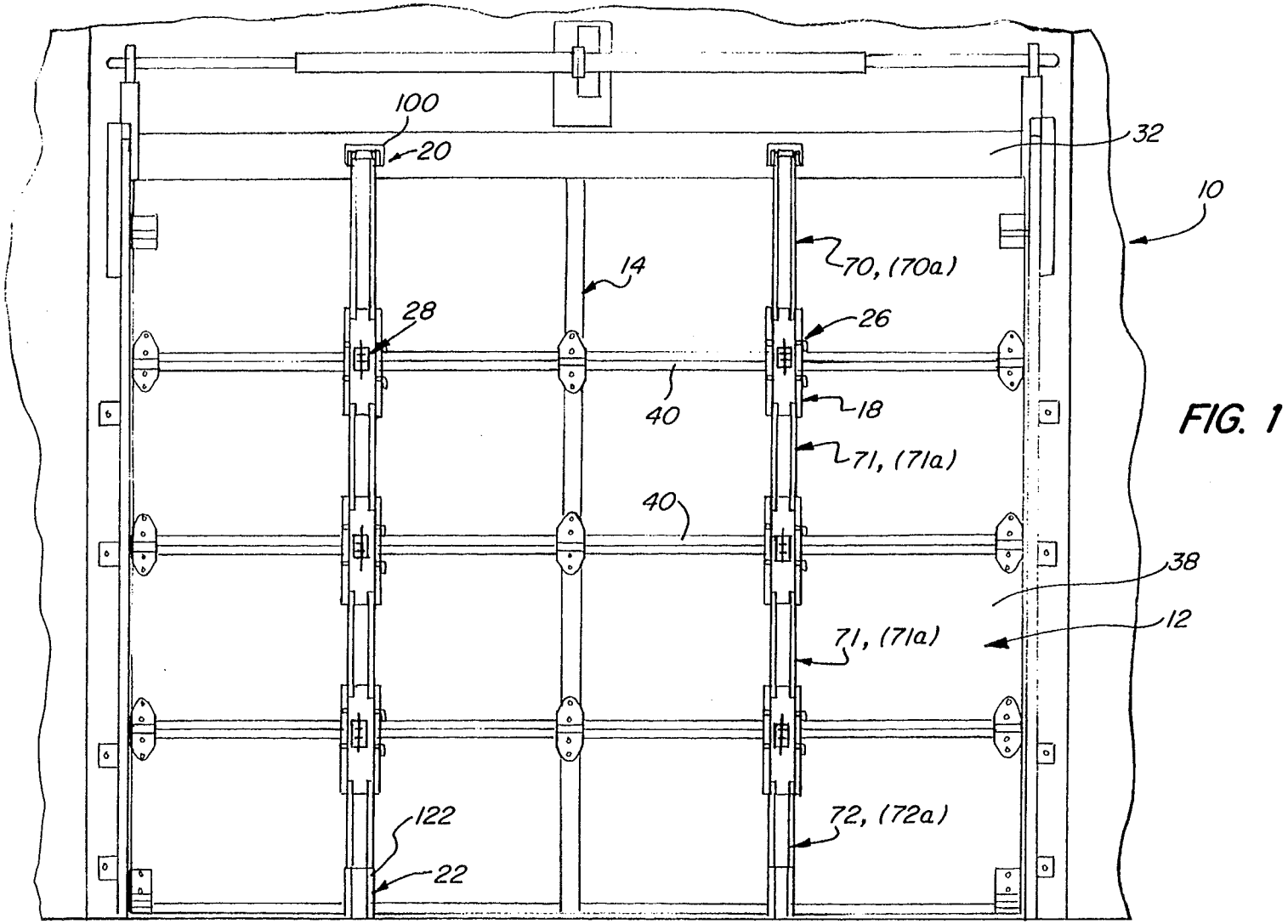
FIG. 1 is an elevational view of a reinforcement assembly embodying the present invention shown mounted on the inside surface of a garage door in a fragmentarily illustrated structure.

Turning now in detail to the attached drawings, a reinforcement assembly embodying the present invention and generally designated by the numeral 10 is illustrated therein as mounted on a door 12 which has stiles generally designated by the numeral 14. The reinforcing assembly includes reinforcing members generally designated by the numerals 70, 71 and 72, cap members generally designated by the numeral 18, a top lock assembly generally designated by the numeral 20, and a bottom lock assembly generally designated by the numeral 22. Pivot members generally designated by the numeral 24 couple the ends of the reinforcing members 70, 71 and 72 and the cap members 18. The reinforcing members 70, 71, 72 and caps 18 are locked in a vertical position by disengageable lock assemblies generally designated by the numeral 26 and disengageable securing assemblies generally designated by the numeral 28. Horizontal support members generally designated by the numeral 30 extend across the assemblies to rigidify larger doors.

Referring in detail to FIG. 1, the door 12 covers an opening (not shown) defined by a doorframe including a header 32. The door 12 has four horizontal panels 38, each having a flange 40 along both its upper and lower edges, and the panels 38 are pivotably connected along their upper and lower edges.

Figure 2:
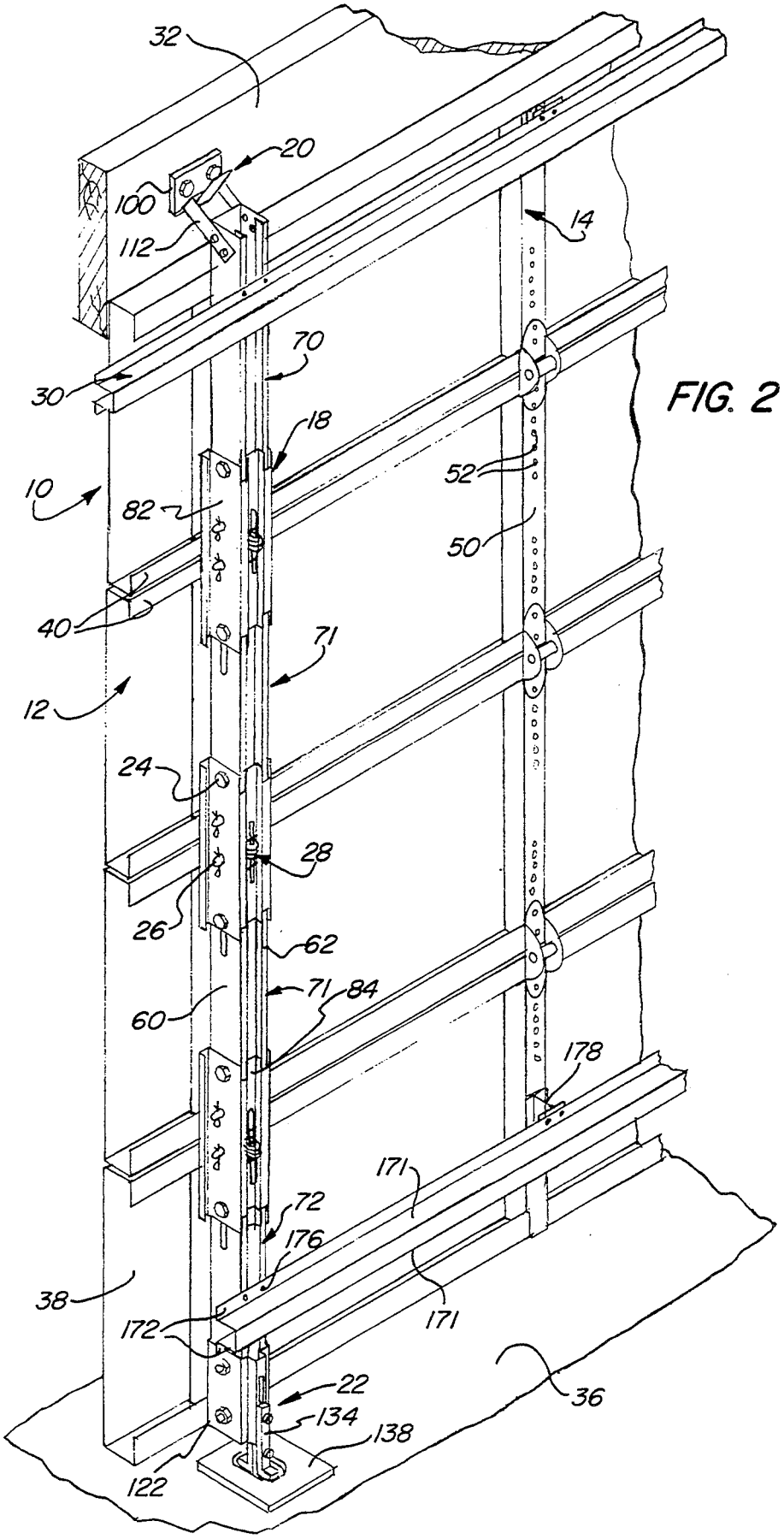
FIG. 2 is an enlarged fragmentary perspective view thereof with the locking members in place.
Figure 3:
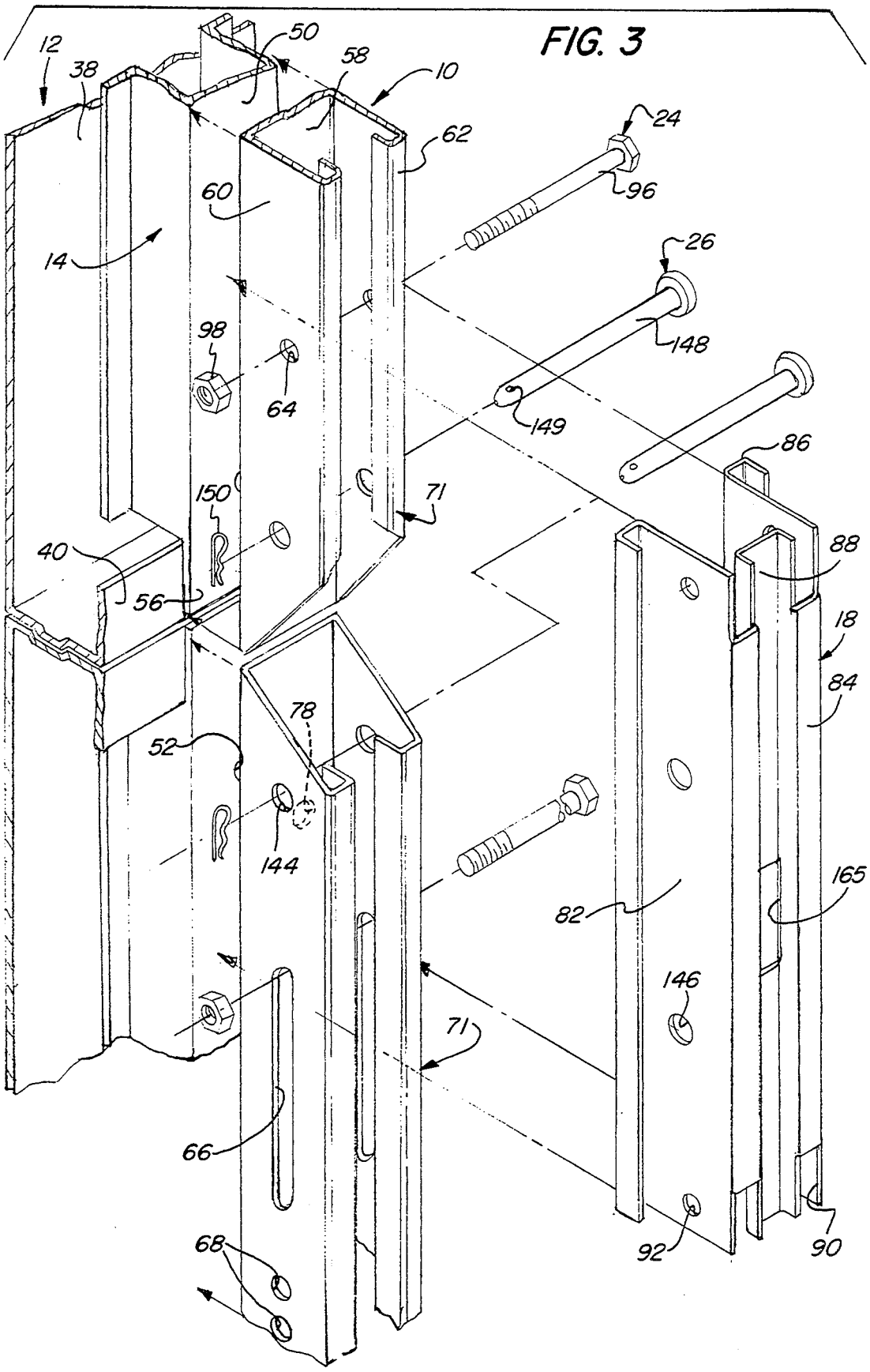
FIG. 3 is an enlarged fragmentary exploded view of a portion of the reinforcement assembly and door panels without securing brackets.
Figure 4:
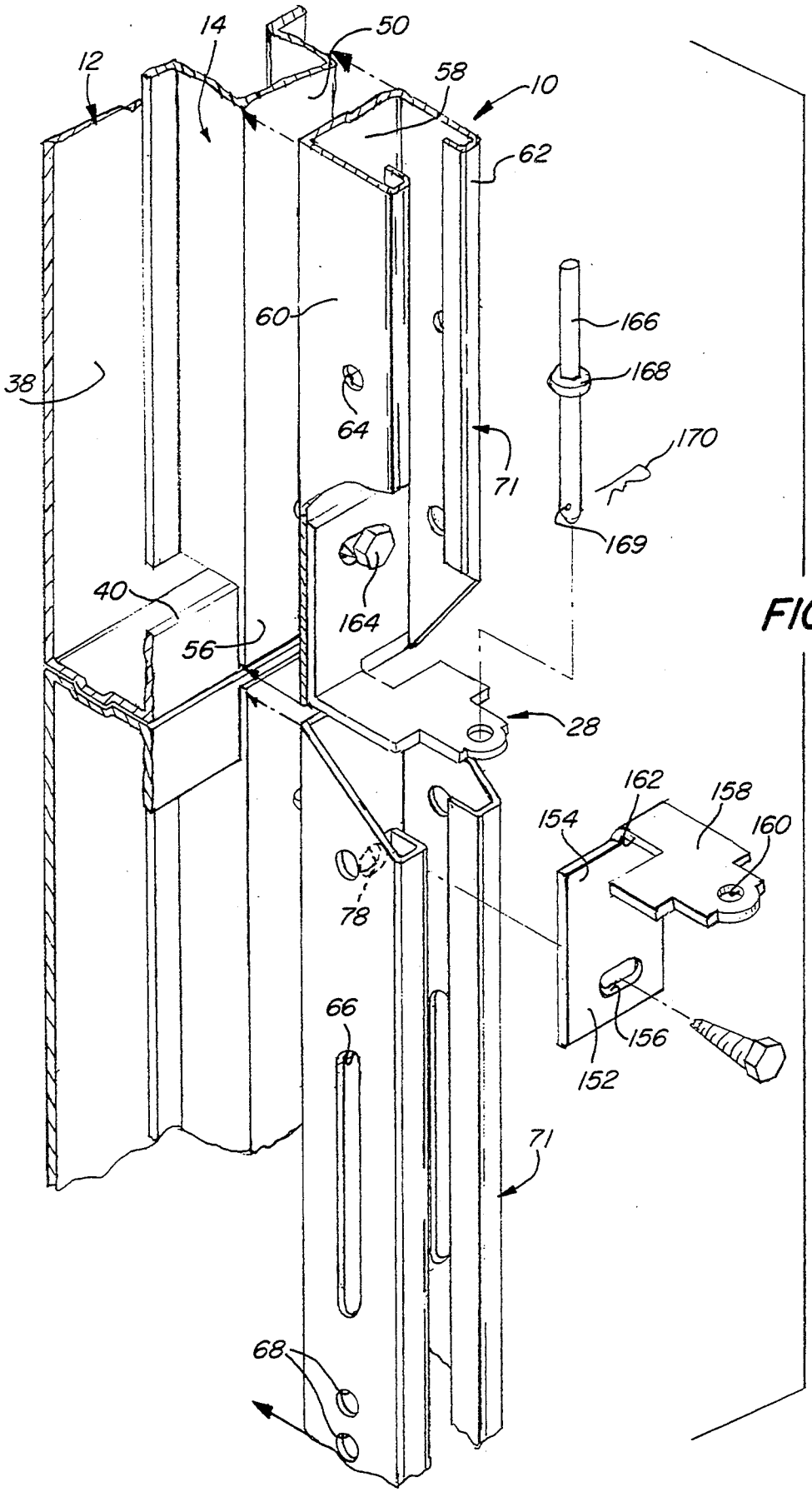
FIG. 4 is a similar exploded view of a portion of the reinforcement assembly with securing brackets and securing pin and omitting the cap member.
Figure 11:
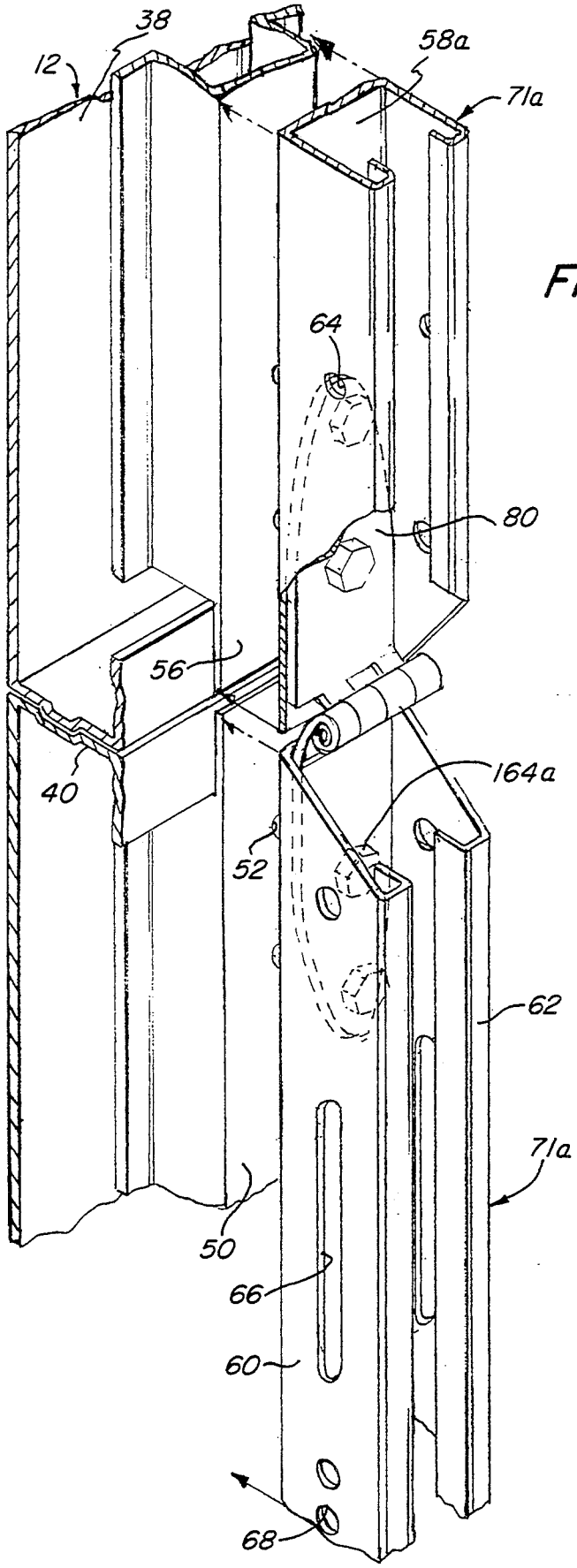
FIG. 11 is an enlarged fragmentary exploded view of a portion of an alternate embodiment of the reinforcement assembly of the present invention, having a hinge in place of the securing brackets and pin.

As seen in FIG. 2, the stiles 14 are mounted to the door 12 in one or more perpendicular lines, perpendicular to the axes of pivotal motion at several points along the width of the door 12, to provide reinforcement. As best shown in FIGS. 3, 4 and 11 of this embodiment, the stiles 14 have a tubular cross section and are secured to the face of the panels 38. The wall 50 of the stile 14 farthest from the door panels 38 is provided with apertures 52 for mounting other portions of the reinforcement assembly 10, and provides flanges 56 at its ends. Each stile 14 is mounted on a panel 38 between its upper and lower flanges 40, upon which its flanges 56 lie. The flanges 56 also allow for fastening of the stile 14 to the panel 38 by mechanical clinching as well as by structural adhesive, as will be described hereinafter.

The intermediate reinforcing members 71 are generally channel shaped, i.e., have a U-shaped cross section with a generally planar web 58 between the two side walls 60 whose free ends form U-shaped inturned flanges 62.

Each side wall 60 has a pivot aperture 64 in its lower portion and a pivot slot 66 in its upper portion. Below the slots 66 in the side walls 60 are storage apertures 68, used for retaining parts of the reinforcement assembly 10 when not in use. The ends of the side walls 60 are angled towards the web so that the web 58 is longer than the inturned flanges 62, giving the side wall 60 a trapezoidal configuration and allowing unencumbered pivotal movement of the reinforcing members 70, 71 and 72.

Figure 5:
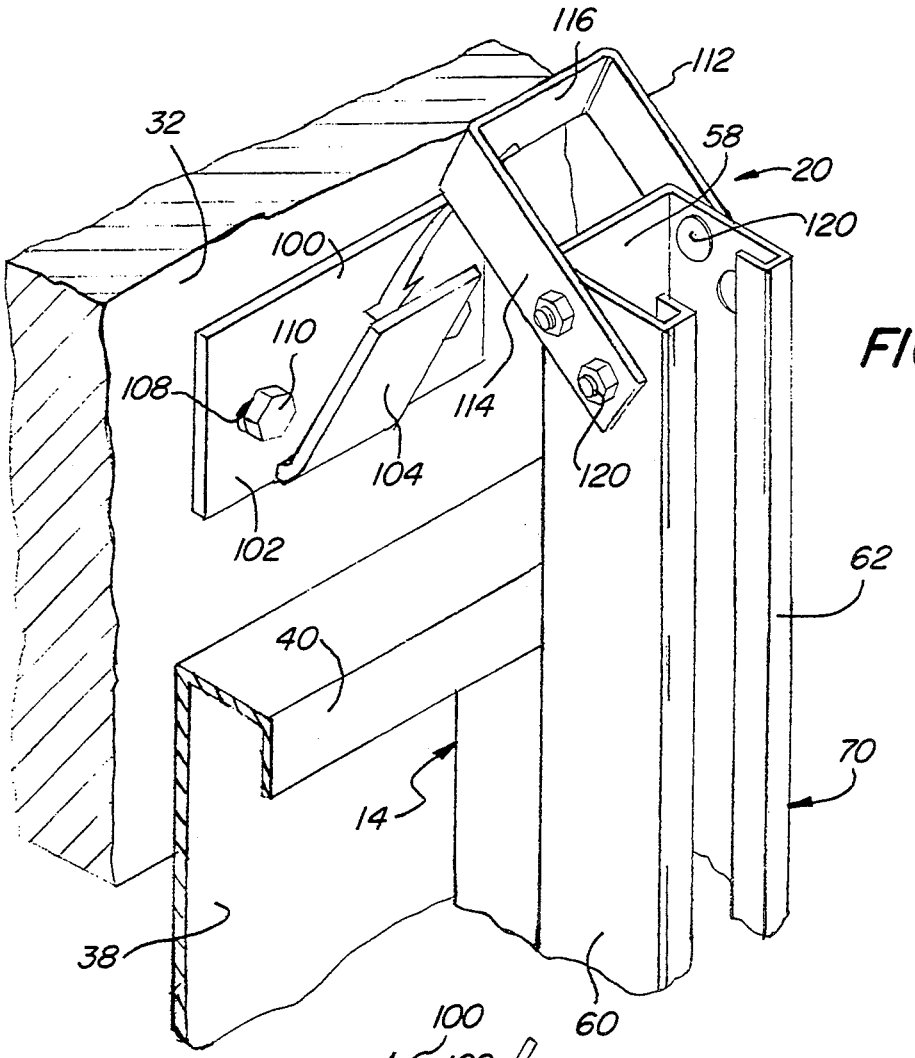
FIG. 5 is an enlarged fragmentary perspective view of the upper end of the reinforcement assembly showing the top lock assembly and a portion of the door and the header of the door frame.
Figure 6:
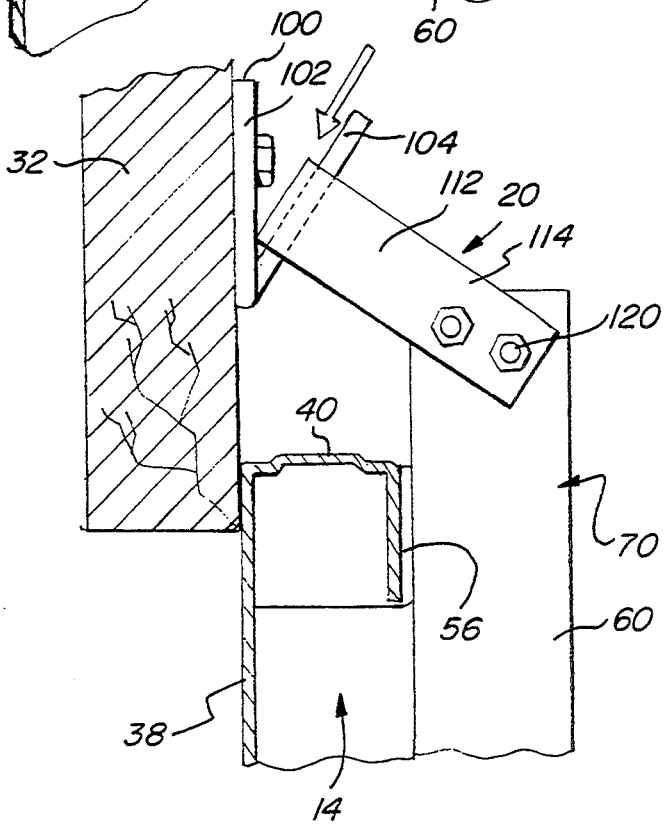
FIG. 6 is a fragmentary side elevational view thereof.

As seen in FIGS. 5 and 6, the uppermost reinforcing member 70 has identical elements to those of intermediate reinforcing member 71 except that the upper edges of the side walls 60 of uppermost reinforcing member 70 are perpendicular to the web 58 instead of extending at an angle thereto. In addition, there is no pivot slot 66 in the upper portion of the side walls 60, but rather apertures (not shown) to receive portions of the top lock assembly 20. Additionally, there are no storage apertures 68 in the side walls 60.

Figure 7:
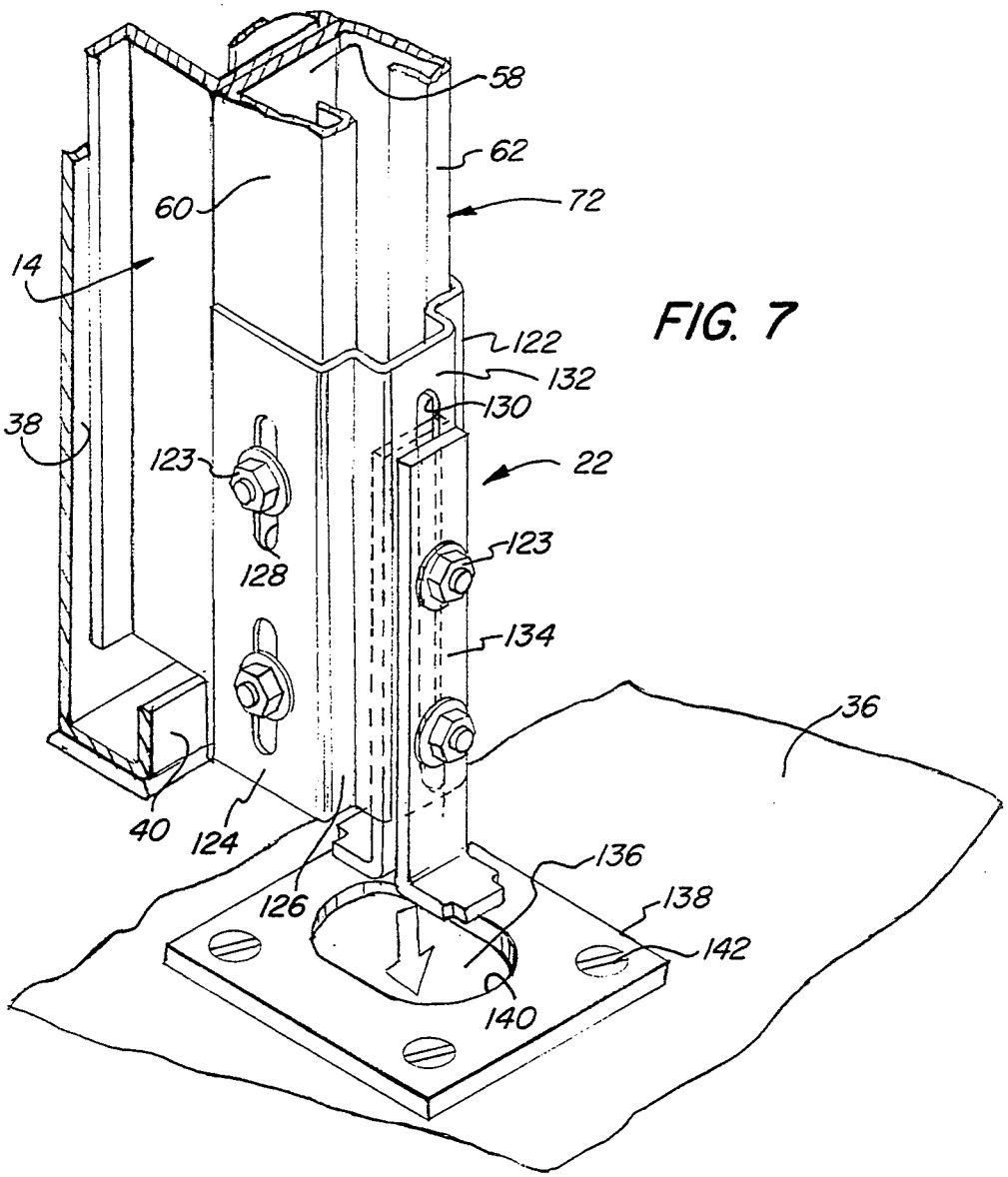
FIG. 7 is an enlarged fragmentary perspective view of the lower portion of the reinforcement assembly showing the bottom lock assembly, a portion of the door and the floor about the door frame.
Figure 8:
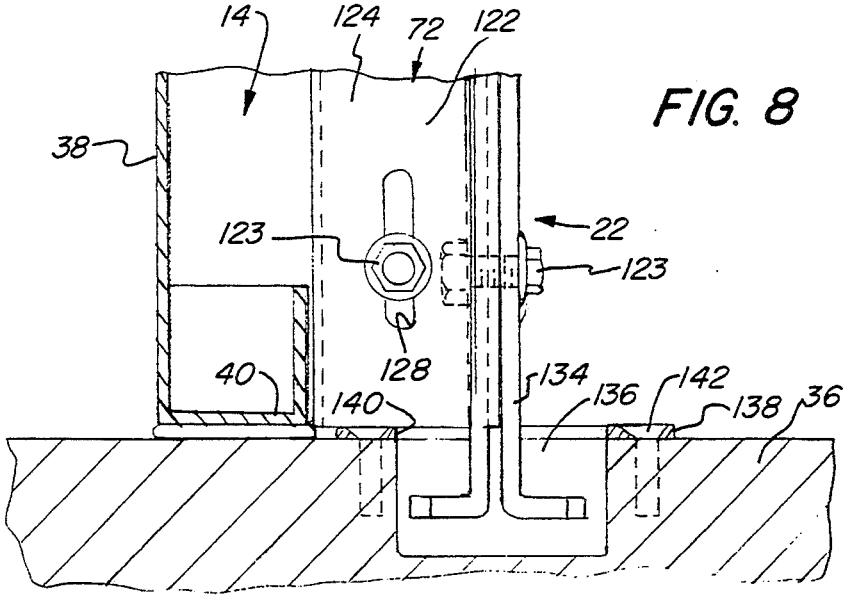
FIG. 8 is a fragmentary side elevational view thereof.
Figure 9:
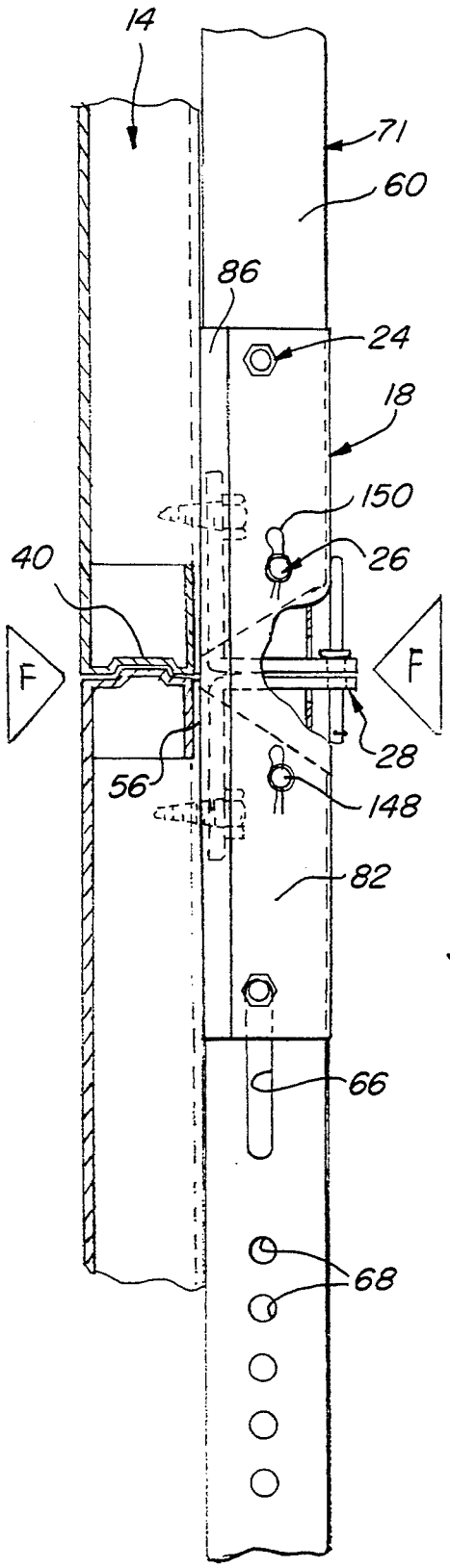
FIG. 9 is an enlarged side elevational view of a portion of the reinforcement assembly with the cap member broken away to show detail of the disengageable securing assembly, and with the disengageable lock assembly and disengageable securing assembly engaged, and further showing the door in section and in closed position.

Similarly, as seen in FIGS. 7 and 8, the lowermost reinforcing member 72 has identical elements to those of intermediate reinforcing member 71 except that the lower portions of its side walls 60 are not provided with pivot apertures 64, but instead are provided with a pair of apertures (not shown) to receive portions of the bottom locking assembly 22.

Apertures 78 are provided on either end of the web 58 of reinforcing members 70, 71, 72 to allow a line of reinforcing members 70, 71, 72 to be mounted upon the lines of stiles 14. Each reinforcing member 70, 71, 72 is directly superimposed upon a stile 14 and the junctures between the reinforcing members 70, 71, 72 are therefore aligned with the junctures between the panels 38 of the door 12.

Referring to FIG. 3, the cap members 18 are generally channel shaped, i.e., have a U-shaped cross section with parallel side walls 82, configured and dimensioned to fit between the inturned flanges 62 of the reinforcing members 70, 71, 72. The free ends of the side walls 82 are formed into outwardly disposed U-shaped flanges 86 to enhance rigidity. The web 84 is provided with cutouts 90 at its ends, configured to receive the inturned flanges 62 of the reinforcing members 70, 71, 72 when the reinforcing members 70, 71 and 72 are pivoted during opening or closing movement of the door 12.

The side walls 82 of the cap member 18 are each provided with pivot apertures 92 in their end portions and are spaced so as to receive therebetween the side walls 60 of the reinforcing members 70, 71, 72, allowing the cap member 18 to overlie the adjacent ends of the reinforcing members 70, 71, 72. In this position, the web 84 of the cap member 18 and the webs 58 of the reinforcing members 70, 71, 72 will oppose one another on opposite sides of the overlapping side walls 60, 82 with the webs 58 of the reinforcing members 70, 71, 72 overlying the stiles 14.

As best seen in FIG. 3, the pivot members 24 are comprised of a bolt 96 and a nut 98 and pivotally fasten the overlying cap member 18 to the adjacent ends of the reinforcing members 70, 71, 72. The bolts 96 pass through pivot apertures 92 in the cap member 18 and aligned pivot apertures 64 and pivot slots 66 in the reinforcing members 70, 71, 72.

Referring to FIGS. 2, 5 and 6, attached to the header 32 above the door 12 is a header member 100 with a base 102 and a hook 104 that extends upwardly and outwardly from the base 102. Fasteners 110 extend through slots 108 in the base 102 and secure the header member 100 to the header 32.

The upper portion of the uppermost reinforcing member 70 extends upwardly beyond the upper edge of the uppermost panel 38 of the door 12. A U-shaped catch member 112, with parallel legs 114 separated by an engaging bar 116, is secured to the side walls 60 of the projecting portion of the uppermost reinforcing member 70 by fasteners 120. The fasteners 120 extend through slots (not shown) in the legs 114 of the catch member 112 and through apertures (not shown) in the side walls 60 of the uppermost reinforcing member 70. The catch member 112 extends upwardly and towards the header member 100. This allows the engaging bar 116 to move in the direction of the arrows in FIGS. 5 and 6 and the hook 104 of the header member 100 to engage the engaging bar 116 when the door 12 moves to a closed position, thereby preventing movement of the uppermost portion of the reinforcement assembly 10. When the door 12 moves to an open position, the hook 104 disengages from the engaging bar 116.

Turning next to FIGS. 2, 7 and 8, the bottom lock assembly 22 includes a mounting bracket 122 attached to the lower portion of the lowermost reinforcing member 72. The mounting bracket 122 is generally channel shaped, i.e., has a U-shaped cross section, and has a pair of parallel spaced side walls 124 separated by a web 126. A pair of slots 128 is provided in each of the side walls 124. Fasteners 123 extend through the slots 128 and aligned apertures (not shown) in the side wall 60 of the lowermost reinforcing member 72, thereby securing the mounting bracket 122 to the lowermost reinforcing member 72. When fastened in this manner, the side walls 124 of the mounting bracket 122 overlie the side walls 60 of the lowermost reinforcing member 72, and the web 126 of the mounting bracket 122 opposes the web 58 of the reinforcing member 72 at opposite ends of the overlying side walls 124, 60.

The web 126 of the mounting bracket 122 has a raised portion 132 extending along its length, and a single slot 130 extends along almost the entire length of the raised portion 132.

One arm of an L-shaped latch member 134 is attached to the outer surface of the raised portion 132 and the other arm is positioned at a level below the lower edge of the door 12 and extends inwardly therefrom. The arm of a second latch member 134 is attached to the inner surface of the raised portion 132 and aligned with the first latch member 134. The other arm of the second latch member 134 is aligned with the first latch member 134 and positioned at a level below the lower edge of the door 12 extending towards it. A pair of fasteners 123 passes through apertures (not shown) in the two latch members 134 and the slot 130 in the web 126 of the mounting bracket 122, thereby adjustably securing both latch members 134 in the described position.

A plate 138 is placed over a recess 136 in the floor 36 adjacent and inwardly of the door 12 and is secured in position by means of fasteners 142 passing through apertures (not shown) in the plate 138.

Turning to FIG. 3, the disengageable lock assembly 26 includes a locking aperture 144 adjacent each end of each side wall 60 of reinforcing members 70, 71, 72. Each locking aperture 144 is spaced from the pivot aperture 64 or pivot slot 66 in the direction of the end of the side wall 60, and a locking aperture 146 is provided adjacent each end of each side wall 82 of the cap members 18. Each locking aperture 146 is spaced from the pivot aperture 92 in the direction opposite from the ends of the side wall 82, and is aligned with a locking aperture 144 in the side wall 60 of the reinforcing members 70, 71, 72 when the cap member 18 overlies their adjacent ends.

The disengageable lock assembly 26 also includes a pair of lock pins 148 that extend through the aligned locking apertures 144, 146 to effectuate the locking. The lock pin 148 is held in its locking position by means of a spring retainer 150 extending through an aperture 149 in the end of the lock pin 148.

Turning next to FIG. 4, the disengageable securing assembly 28 has a pair of generally L-shaped securing brackets 152, having a base 154 with a slot 156 and an upstanding arm 158 with an aperture 160 adjacent its free end. A cutout 162 in the arm 158 at its juncture with the base 154 allows the arms 158 of the two securing brackets 152 to be interlocked with their bases 154 coplanar. A fastener 164 extends through the slot 156 in the base 154 of each bracket 152 to the adjoining ends of webs 58 of the adjoining reinforcing members 70, 71, 72. When the arms 158 of the brackets 152 are engaged, the upstanding arms extend inwardly from the door 12 and at right angles to the web 58. The fastener closest to the end may also be used to secure the reinforcing members 70, 71, 72 to the walls 50 of the underlying stiles 14.

The disengageable securing assembly 28 also includes an aperture 165 in the web 84 of the cap member 18, as best seen in FIG. 3, and it is configured and dimensioned to receive the free ends of the upstanding arms 158. The upstanding arms 158 are dimensioned and the apertures 160 located so that the apertures 160 are closely spaced above the outer surface of the web rib 88 of the cap member 18, slightly beyond the aperture 165. An elongated securing pin 166 seats in the apertures 160 of the upstanding arms 158 and extends along the outer surface of the rib 88. This prevents the arms 158 from withdrawing from the aperture 165, and thereby prevents the adjacent ends of the reinforcing members 70, 71, 72 from moving in a direction away from the cap member 18. A stop 168 in the form of a washer placed around the securing pin 166, prevents the securing pin 166 from falling through the apertures 160. A spring retainer 170 is inserted in an aperture 169 in one end of the securing pin 166 to retain it in the apertures 160.

Referring next to FIG. 2, one or more horizontal support members 30 may be provided intermediate the height of the door to provide greater rigidity to wider doors, and they are generally channel shaped, i.e., have a U-shaped cross section. Side walls 171 have outwardly turned flanges 172 for additional rigidity. Fasteners 176 secure the horizontal support members 30 to the portions of the reinforcing members 70, 71, 72 intermediate their ends. Additionally, support spacers 178 are affixed between stiles 14 and the horizontal support member 30 where there are no reinforcing members 70, 71, 72, to provide proper spacing.

Figure 10:
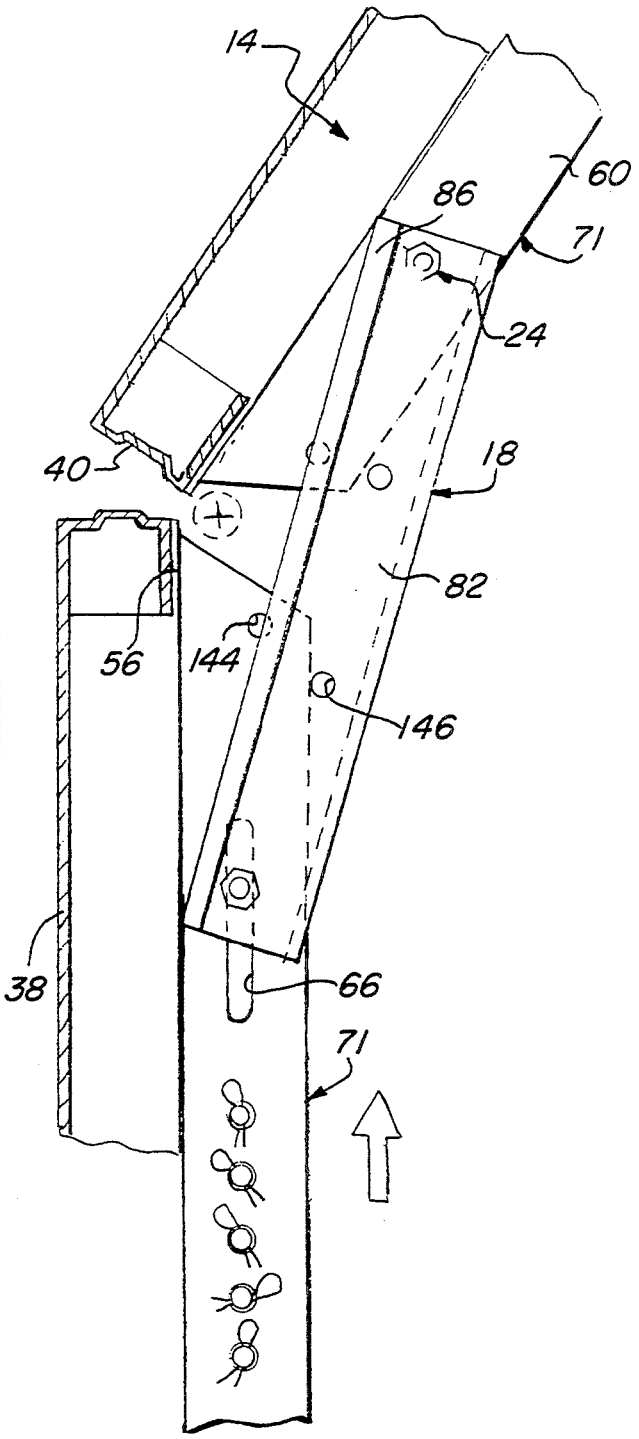
FIG. 10 is a similar view with the disengageable lock assembly and disengageable securing assembly disengaged and the door moving into an open position.

In operation of the door 12 and reinforcement assembly 10 illustrated in FIGS. 1–11, as the door 12 slides upwardly toward a horizontal position and downwardly, the panels 38 pivot in the manner indicated in FIG. 10. Although the reinforcing members 70, 71, 72 are rigidly secured to the stiles 14 which are in turn secured to the several panels 38, the cap members 18 permit collapsing of the reinforcement assembly from the straight position shown in FIG. 9 by reason of the slots 66 which permit the pivot members 24 to travel freely therein.

In moving to a closed position, the door 12 moves downwardly and, as it reaches the bottom of its path, the hook 104 of the header member 100 engages the catch member 112 so that the top of the uppermost reinforcing member 70 is held against movement both toward and away from the header 32. Similarly, the bottom of the lowermost reinforcing member 72 is held against movement both toward and away from the door frame by reason of the engagement of the latch members 134 with the plate 138. The several stiles 14 and reinforcing members 70, 71, 72 reinforce the several panels 38 of the door 12 against pressures tending to collapse them inwardly and themselves are held from collapsing by the webs 84 of the cap members 18 which prevent the adjacent ends from pivoting inwardly of the garage.

The adjacent ends of the reinforcing members 70, 71, 72 are further prevented from pivoting inwardly by the lock pins 148 of the disengageable lock assembly 26 when engaged. The same lock pins 148 also prevent the adjacent ends of the reinforcing members 70, 71, 72 from pivoting outwardly, as would occur if the door 12 were buckling outwardly. The disengageable lock assembly 26 is engaged by inserting the lock pins 148 into the apertures 144, 146 in the reinforcing member 70, 71, 72 and cap member 18, respectively, and holding them in place by means of spring retainers 150.

Additional protection against outward pivoting of the adjacent ends of the reinforcing members 70, 71, 72 away from the cap members 18 is afforded by the disengageable securing assembly 28. When the door 12 is in the closed position, the disengageable securing assembly 28 is engaged by inserting the securing pin 166 into the apertures 160 of the arms 158 of the brackets 152. The spring retainer 170 is then inserted in aperture 169 to retain the securing pin 166 in position.

The disengageable lock assembly 26 and the disengageable securing assembly 28 are only engaged when high wind conditions are anticipated. When both assemblies 26, 28 are engaged, the door is properly reinforced against buckling under either positive or negative wind forces. When the risk of high winds has abated, and it is desired to operate the door in the normal fashion, the spring retainers 150, 170 are removed and the lock pin 148 and securing pin 166 are withdrawn from the apertures 144, 146, and 160. This will allow the door 12 to move freely between its closed and open positions.

The reinforcement assembly 10 illustrated in FIGS. 1–11 is readily assembled to the overhead door after at least one vertical line in a desired position along the door span has been marked on the rear surface of the door. A stile 14 is mounted to each of the panels 38 along the marked vertical line with the flanges 56 of the stiles 14 fitting over the flanges 40 of the panels 38 and attached by mechanical clinching and adhesive to panel 38. A reinforcing member 70, 71, 72 is positioned over each stile 14 along the vertical line with the apertures (not shown) in the ends of its web 58 aligned with the apertures 52 in the stile 14 that it superimposes. A securing bracket 152 is placed over each of the adjacent ends of the reinforcing members 70, 71, 72 with its slot 156 aligned with the aperture (not shown) in the ends of the web 58 of the reinforcing members 70, 71, 72. A single fastener 164 can then be employed to secure the securing bracket 152, reinforcing members 70, 71, 72, and stile 14 to the panel 38.

The cap members 18 are then fitted over the adjacent ends of the reinforcing members 70, 71, 72 and secured in position to provide a hinged connection therebetween by pivot members 24 which extend through the pivot apertures 92 of the cap member 18 and the pivot slots 66 and pivot apertures 64 of the reinforcing members 70, 71, 72.

A recess 136 is formed in the floor 36 of the garage and the plate 138 is secured in position by fasteners 142. The latch members 134 are secured to the mounting bracket 122 in the positions previously described, using fasteners 123. The slot 130 permits vertical adjustment of the lower arms of the latch members 134 relative to the plate 138 when the door 12 is in its closed position. Once the latch members 134 are attached, the mounting bracket 122 is secured to the lower portion of the lowermost reinforcing member 72, using fasteners 123. The slots 128 in the brackets 122 allow for further adjustment.

The header member 100 is secured to the header 32 of the door frame in as low a position as possible to permit clearance of the door 12 in its movement between open and closed positions. The catch member 112 is secured to the upper portion of the uppermost reinforcing member 70 in the manner discussed above. The slots (not shown) in the legs 114 of the catch member 112 permit adjustment of the catch member 112 relative to the header member 100 when the door 12 is in its closed position. In this manner, the catch member 112 can be adjusted to be fully engaged by the hook 104 provided by the header member 100 before it is locked into position by the fasteners 120.

An alternate embodiment of the reinforcement assembly 10*a* is shown in FIG. 11. This embodiment is employed where reinforcement of a door 12 is desired, but the potential for extreme wind forces is reduced. All elements of this embodiment are the same as those for the prior embodiment except as noted. The disengageable securing assembly 28 is omitted from this embodiment, and in place of the securing brackets 152, hinges 80 may be used to hingedly connect adjacent ends of reinforcing members 70*a*, 71*a*, 72*a*. The hinge 80 is placed over the adjacent ends of the reinforcing members 70*a*, 71*a*, 72*a* with the apertures (not shown) in hinge 80 being aligned with the apertures (not shown) in the ends of the web 58*a* of the reinforcing members 70*a*, 71*a*, 72*a*. Fasteners 164*a* may be used to secure the hinge 80, and reinforcing members 70*a*, 71*a*, 72*a*, to the stile 14*a*.

Although the structures illustrated in FIGS. 1–11 may be used on single width doors, the invention may be adapted readily to doors of greater width by the use of two or more vertical lines of stiles 14, reinforcing members 70, 71, 72 and cap members 18, and the related structure, spaced across the width of the door.

Figure 12:
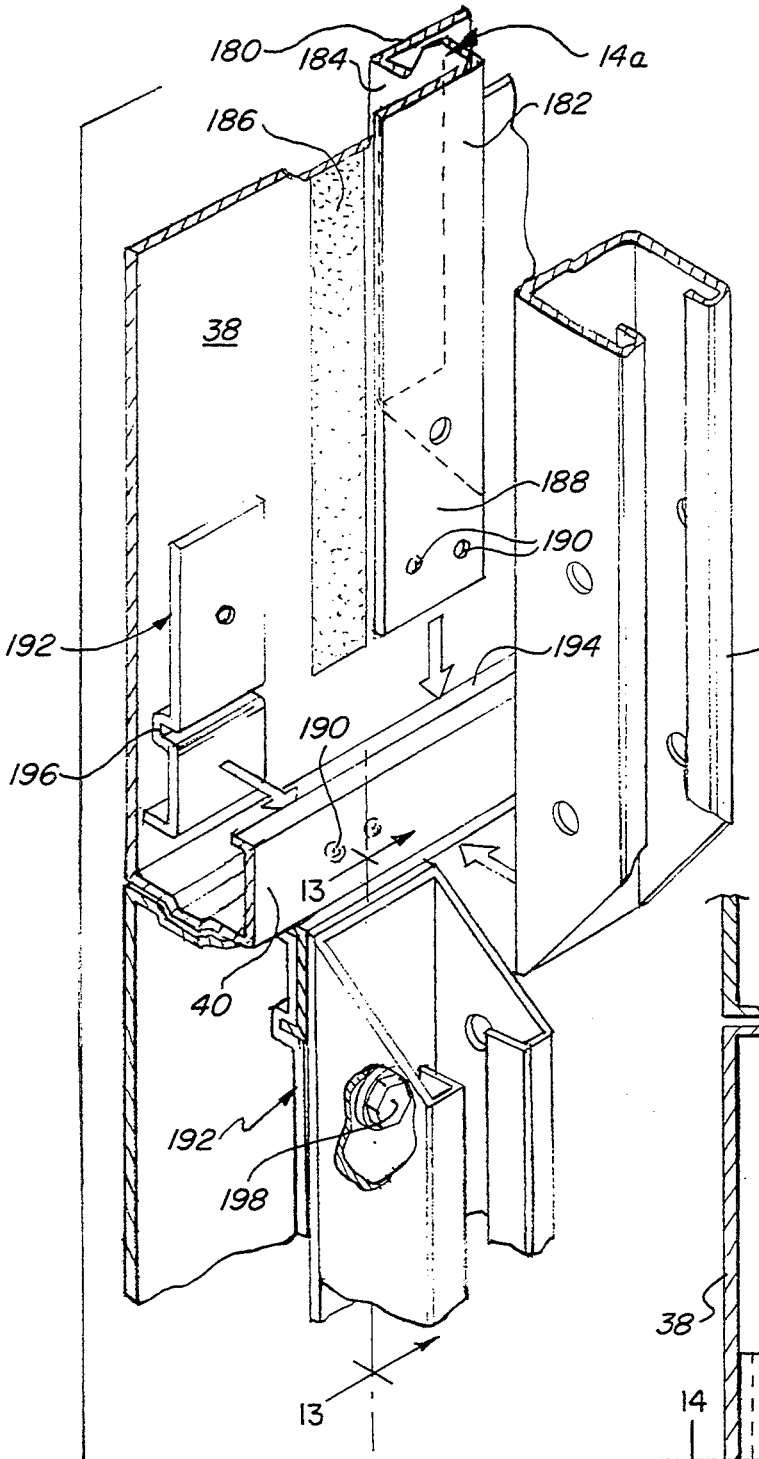
FIG. 12 is a fragmentary exploded view of a preferred embodiment of stile and panel mounting assembly.
Figure 13:
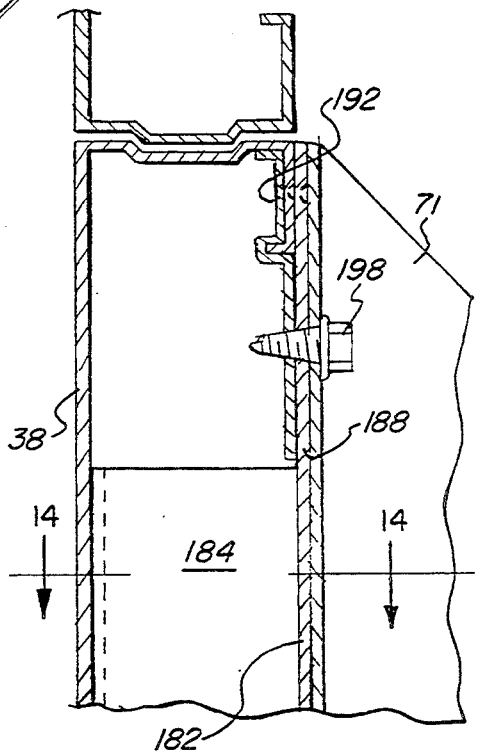
FIG. 13 is a fragmentary sectional view of the assembly along the line 13—13 of FIG. 12.
Figure 14:
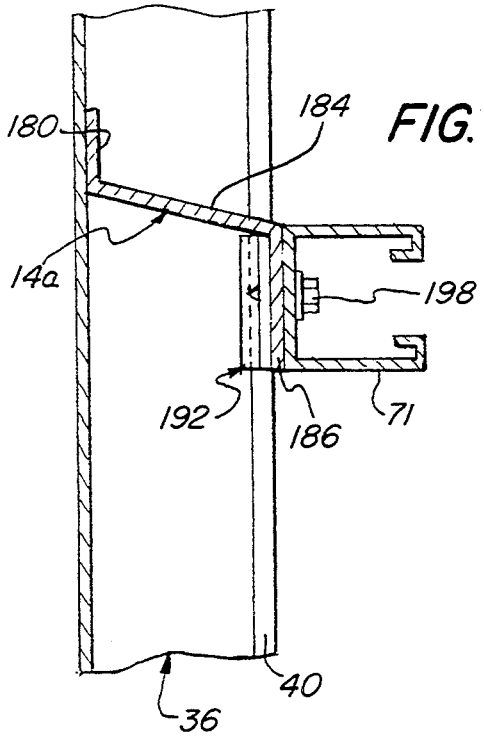
FIG. 14 is a fragmentary sectional view of the assembly along the line 14—14 of FIG. 13.

Turning next to FIGS. 12–14 therein illustrated is a preferred assembly of stile and panel. In this embodiment, the stile 14*a* is of generally Z-shaped configuration with legs 180, 182 and a web 184 extending therebetween. The leg 180 is bonded to the surface of the panel 36 by a structural adhesive 186 shown by the stippling in FIG. 12. The end portion of the leg 180 and web 184 are cut away so that the end portion of the leg 182 provides a tongue 188 which extends over the flange 40 on the panel 36. This tongue 188 is mechanically secured to the flange 40 by clenching or deforming portions of the tongue and panel as indicated by the numeral 190.

To increase the rigidity of the inner connection, a backing plate generally designated by the numeral 192 is disposed below the flange 40 of the panel 36 and the leg 182 of the stile 14*a*. In this embodiment, the flange 40 has a depending lip 194 which extends into the channel 196 which has been formed in the backing plate 192. This assembly is secured by the fastener 198 which extends through the reinforcing member 71, and the leg 182 of the stile and backing member 192 to provide a relatively high degree of rigidity to the assembly.

Figure 15:
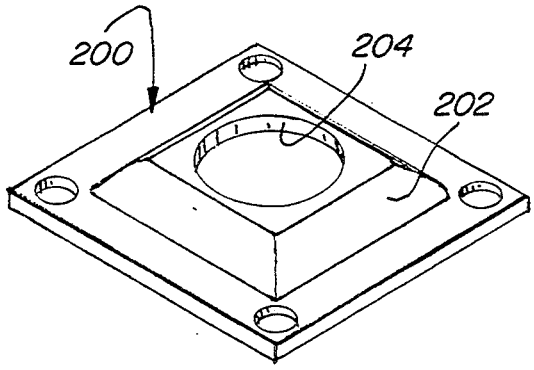
FIG. 15 is a perspective view of a preferred embodiment of bottom locking plate.
Figure 16:
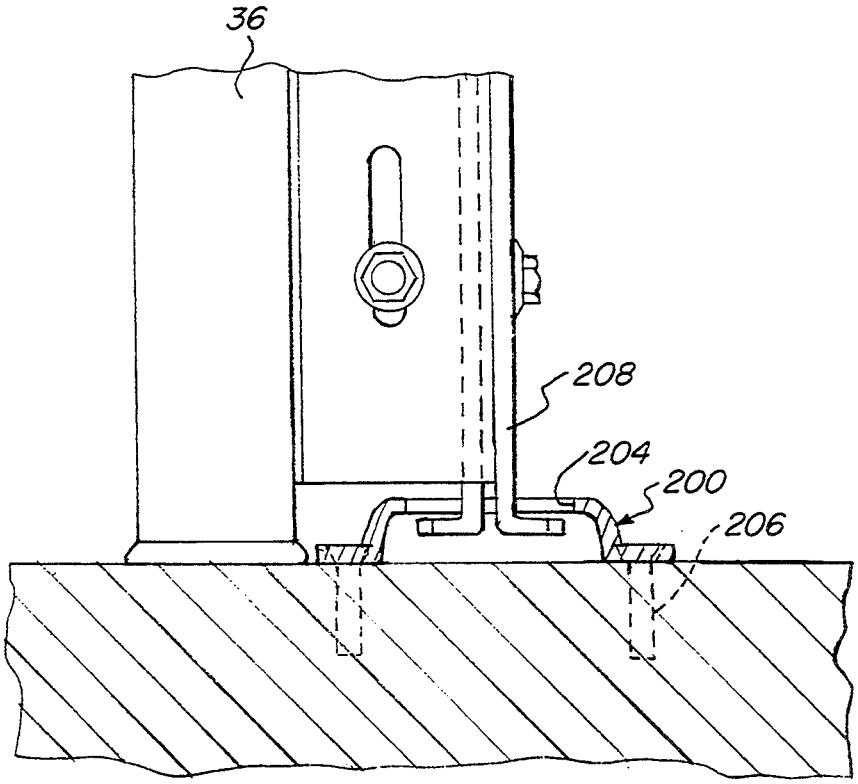
FIG. 16 is a fragmentary elevational view in partial section of a door assembly employing the locking plate of FIG. 15.

Turning now to FIGS. 15 and 16, therein illustrated is an alternate embodiment of the bottom locking assembly. In this instance, instead of providing a depression in the concrete floor of the garage, the locking plate generally designated by the numeral 200 is formed with an upstanding pedestal portion 202 having a circular cutout 204 therein. Thus, the locking plate 200 can be secured to the floor by bolts 206 indicated in phantom line in FIG. 16, and the slide lock 208 will extend into the cavity provided thereby to firmly engage the bottom of the reinforcing assembly to the floor.

Various modifications of the present invention may be employed. In place of the bottom lock assembly shown in FIGS. 7 and 8, an alternate structure employs an upstanding hook or post on a floor mounted plate which provides stops against which the lowermost reinforcing member abuts so as to prevent movement of the lowermost portion of the reinforcement assembly. Other connections providing hinged movement of the several reinforcing members and cap members may also be employed so long as the reinforcement assembly is rigidly held from buckling under both positive and negative pressures when the door is in the closed position. The specific supports and mounting elements for the stiles will vary with the type of door and the configuration of its panels, etc., and the configuration of the several reinforcing members and cap members may also vary.

Thus, it can be seen from the foregoing detailed specification and attached drawings that the novel reinforcement assembly of the present invention provides novel reinforcement for a multipaneled door of the overhead type, which allows it to resist both positive and negative forces acting on its outer surface. Additionally, it may be readily disengaged to avoid interference with the opening and closing movement of the door during normal use, and may be easily installed after fabrication and installation of the door. Fabrication of the reinforcement assembly may be accomplished readily and economically.

Having thus described the invention, what it claimed is:

1. A reinforcement assembly for reinforcing a door of the overhead type having a plurality of horizontally extending panels pivotably connected along their top and bottom edges comprising:

(a) a plurality of elongated reinforcing members dimensioned and configured to be operatively mounted vertically on the inner surface of an associated door between the top edge and the bottom edge of each of the several door panels;

(b) a plurality of cap members overlying the adjacent ends of said reinforcing members;

(c) pivot means pivotally connecting said cap members to said adjacent ends of said reinforcing members and permitting relative pivotal movement of said adjacent ends of said reinforcing members in the direction away from said cap members for pivoting of the panels of the associated door as the door is moved between open and closed positions, the configuration of said cap members and pivot means preventing pivoting of said ends of said reinforcing members in the direction of said cap members to prevent buckling of the associated door in the closed position thereof under pressures applied externally thereof; and (d) disengageable lock means engageable with said cap members and said ends of said reinforcing members at a point spaced from said pivot means to prevent pivoting of said ends of said reinforcing members away from said cap members to prevent buckling of the panels of the associated door in the closed position thereof under positive and negative pressures applied thereto.

2. The reinforcement assembly in accordance with claim 1 including top locking means having a header member attachable to the associated header of the frame of the associated door and a catch member on the upper end of the uppermost reinforcing member, said catch member being engageable with said header member in the closed position of the associated door to prevent movement of the upper end of said reinforcement assembly, said catch member being disengageable from said header member upon opening movement of the associated door.

3. The reinforcement assembly in accordance with claim 2 wherein said header member has a hook projection and said catch member has a projecting portion in which said hook is engageable in the closed position of the associated door.

4. The reinforcement assembly in accordance with claim 1 including bottom locking means, including a latch member on the lower end of the lowermost reinforcing member for engagement with the floor of the structure about the door opening when the associated door is in the closed position to prevent movement of the lower end of said reinforcement assembly, said latch member being readily disengageable upon opening movement of the associated door.

5. The reinforcement assembly in accordance with claim 4 wherein said latch member extends beyond the lower end of the lowermost reinforcing member and wherein said bottom locking means also includes a plate having a recess therein and adapted to be secured to the floor inwardly of the associated door to provide a catch aperture for said latch member when the associated door is in a closed position.

6. The reinforcement assembly in accordance with claim 1 wherein said reinforcing members are of generally channel-shaped configuration with the web thereof being adapted to be disposed adjacent the panels of the associated door and the side walls thereof being provided with apertures to seat said pivot means.

7. The reinforcement assembly in accordance with claim 1 wherein said cap members are of generally channel-shaped configuration and wherein the end portions of said reinforcing members are received between the side walls thereof and abut against the web thereof so as to be limited in movement in the direction of said cap members, said side walls of said cap members being provided with apertures to seat said pivot means, said web of said cap members having cutouts adjacent the ends thereof to permit limited pivotal movement of said reinforcing members during opening and closing movement of the associated door.

8. The reinforcement assembly in accordance with claim 1 wherein one of said reinforcing and cap members has elongated slots therein and the other of said members has apertures therein and wherein said pivot means comprises pivot members extending through said slots and apertures.

9. The reinforcement assembly in accordance with claim 1 wherein said cap members are of generally channel-shaped configuration and wherein said reinforcing members are also of generally channel-shaped configuration with their side walls receivable between the side walls of said cap members, the webs of said reinforcing members being disposed adjacent the panels of the associated door and the webs of said cap members being disposed at the opposite end of said interfitting side walls, said webs of said cap members having cutouts in the end portions to permit limited pivotal movement of said reinforcing members during opening and closing movement of the associated door, said side walls of said reinforcing members having elongated slots adjacent one end and apertures adjacent the other end thereof and said side walls of said cap members having cooperating apertures, said pivot means comprising pivot members seated in said cooperating apertures and slots.

10. The reinforcement assembly in accordance with claim 1 including a plurality of stiles dimensioned and configured to be mounted vertically on the several door panels of the associated door, said reinforcing members being mounted on said stiles.

11. The reinforcement assembly in accordance with claim 1 including horizontal support members mounted on said reinforcing members.

12. The reinforcement assembly in accordance with claim 1 wherein said disengageable lock means includes apertures in said side walls of said reinforcing members spaced from said pivot means and cooperating apertures in said sidewalls of said cap members and wherein disengageable lock members extend through said apertures.

13. The reinforcement assembly in accordance with claim 12 wherein said side walls of said reinforcing members are provided with apertures spaced from the ends of said cap members to receive said disengageable lock members for storage when said lock members are not in a locking position.

14. The reinforcement assembly in accordance with claim 1 including hinge members mounted on said adjacent ends of said reinforcing members to provide a pivotal connection therebetween.

15. The reinforcement assembly in accordance with claim 1 wherein there is included a pair of brackets secured to said adjacent ends of said reinforcing members with outwardly extending portions configured to pivot relative to each other and interfit in the vertical position of the reinforcing assembly, and a disengageable locking member engaging the interfitting portions to lock them against relative pivotal movement.

16. The reinforcement assembly in accordance with claim 15 wherein said outwardly extending portions protrude through an aperture intermediate the length of said cap member, and the locking member is an elongated member passing through aligned apertures in said protruding portions to prevent pivoting of said ends of said reinforcing members away from said cap members.

17. The reinforcement assembly in accordance with claim 16 wherein said elongated member and apertures are configured and dimensioned so that said elongated member bears upon said cap member.

18. In combination:

(a) a building structure having a door opening with a frame providing a header thereabove and a floor therebelow;

(b) a door of the overhead type having a plurality of horizontally extending panels pivotably connected along their top and bottom edges;

(c) a plurality of elongated reinforcing members dimensioned and configured to be operatively mounted vertically on the inner surface of the associated door between the top edge and the bottom edge of each of said several door panels;

(d) a plurality of cap members overlying the adjacent ends of said reinforcing members;

(e) pivot means pivotally connecting said cap members to said adjacent ends of said reinforcing members and permitting relative pivotal movement of said adjacent ends of said reinforcing members in the direction away from said cap members for pivoting of said panels of said door as said door is moved between open and closed positions, the configuration of said cap members and pivot means preventing pivoting of said ends of said reinforcing members in the direction of said cap members to prevent buckling of said door in the closed position thereof under pressures applied externally thereof; and (f) disengageable lock means engageable with said cap members and said ends of said reinforcing members at a point spaced from said pivot means to prevent pivoting of said ends of said reinforcing members away from said cap members to prevent buckling of said panels of said door in the closed position thereof under positive and negative pressures applied thereto.

19. The reinforcement assembly in accordance with claim 18 including top locking means having a header member mounted to said header of said frame of said door and a catch member on the upper end of the uppermost reinforcing member, said catch member being engageable with said header member in the closed position of said door to prevent movement of the upper end of said reinforcement assembly, said catch member being disengageable from said header member upon opening movement of said door, and further including bottom locking means, including a latch member on the lower end of the lowermost reinforcing member for engagement with the floor of the structure about said door opening when said door is in the closed position to prevent movement of the lower end of said reinforcement assembly, said latch member being readily disengageable upon opening movement of said door.

20. The reinforcement assembly in accordance with claim 19 wherein said header member has a hook projection and said catch member has a projecting portion in which said hook is engageable in the closed position of said door, and wherein said latch member extends beyond the lower end of the lowermost reinforcing member, said bottom locking means also including a plate having a recess therein and adapted to be secured to the floor inwardly of said door to provide a catch aperture for said latch member when said door is in a closed position.

21. The reinforcement assembly in accordance with claim 18 wherein said cap members are of generally channel-shaped configuration and wherein said reinforcing members are also of generally channel-shaped configuration with their side walls receivable between the side walls of said cap members, the webs of said reinforcing members being disposed adjacent said panels of said door and the webs of said cap members being disposed at the opposite end of said interfitting side walls thereof, said webs of said cap members having cutouts in the end portions to permit limited pivotal movement of said reinforcing members during opening and closing movement of said door, said side walls of said reinforcing members having elongated slots adjacent one end and apertures adjacent the other end thereof and said side walls of said cap members having cooperating apertures, said pivot means comprising pivot members seated in said cooperating apertures and slots.

22. The reinforcement assembly in accordance with claim 18 including a plurality of stiles dimensioned and configured to be mounted vertically on said several door panels of said door, said reinforcing members being mounted on said stiles.

23. The reinforcement assembly in accordance with claim 18 wherein said disengageable lock means includes apertures in said side walls of said reinforcing members spaced from said pivot means and cooperating apertures in said sidewalls of said cap members and wherein disengageable lock members extend through said apertures.

24. The reinforcement assembly in accordance with claim 18 including hinge members mounted on said adjacent ends of said reinforcing members to provide a pivotal connection therebetween.

25. The reinforcement assembly in accordance with claim 18 wherein there is included a pair of brackets secured to said adjacent ends of said reinforcing members with outwardly extending portions configured to pivot relative to each other and interfit in the vertical position of the reinforcing assembly, and a disengageable locking member engaging the interfitting portions to lock them against relative pivotal movement.

26. The reinforcement assembly in accordance with claim 25 wherein said outwardly extending portions protrude through an aperture intermediate the length of said cap member, and the locking member is an elongated member passing through aligned apertures in said protruding portions to prevent pivoting of said ends of said reinforcing members away from said cap members.

27. The reinforcement assembly in accordance with claim 26 wherein said elongated member and apertures are configured and dimensioned so that said elongated member bears upon said cap member.

* * * * *